US005329736A

United States Patent [19]

Sodervall

[11] Patent Number: 5,329,736

[45] Date of Patent: Jul. 19, 1994

[54] DOOR CONSTRUCTION FOR VERTICAL REFRIGERATOR AND FREEZER SPACES

[75] Inventor: Sven-Erik Sodervall, Edane, Sweden

[73] Assignee: Termofrost AB, Kista, Sweden

[21] Appl. No.: 25,756

[22] Filed: Mar. 3, 1993

Related U.S. Application Data

[63] Continuation-in-part of Ser. No. 932,739, Aug. 25, 1992, abandoned, which is a continuation of Ser. No. 542,989, Jun. 25, 1990, abandoned.

[30] Foreign Application Priority Data

Jun. 30, 1989 [SE] Sweden ..... 8902390-7

[51] Int. Cl.[5] ..... A47F 3/04

[52] U.S. Cl. ..... 52/171.3; 312/236; 312/116; 62/255

[58] Field of Search ..... 52/171 R, 788; 312/236, 312/116; 62/248, 247, 255

[56] References Cited

U.S. PATENT DOCUMENTS

| | | | |
|---|---|---|---|
| 4,035,608 | 7/1977 | Stromquist . | |
| 4,117,698 | 10/1978 | Vogel | 312/116 |
| 4,180,954 | 1/1980 | Gell, Jr. | 52/171 R |
| 4,206,615 | 6/1980 | Sobajima et al. . | |
| 4,382,177 | 5/1983 | Heany . | |
| 4,477,129 | 10/1984 | Heaney | 312/116 |
| 4,760,708 | 8/1988 | Karashima | 62/255 |
| 4,896,785 | 1/1990 | Sodervall . | |
| 4,913,223 | 4/1990 | Mizuno et al. | 312/236 |
| 4,970,874 | 11/1990 | Solak et al. | 312/236 |
| 4,977,754 | 12/1990 | Upton et al. | 312/116 |
| 5,173,800 | 12/1992 | King | 52/171 R |

FOREIGN PATENT DOCUMENTS

| | | | |
|---|---|---|---|
| 2639424 | 5/1990 | France | 312/236 |

*Primary Examiner*—Carl D. Friedman
*Assistant Examiner*—Wynn E. Wood
*Attorney, Agent, or Firm*—Nies, Kurz, Bergert & Tamburro

[57] ABSTRACT

A door structure, for use in combination with upright refrigerator and freezer spaces, which utilizes heat transfer by forced convection, of the kind used in everyday commodity stores to display goods on sale. The door has two glass panes which together with a frame embracing the edges of the glass panes, either completely or partially, form a door leaf. The glass pane which faces towards the warm atmosphere of a shop area is provided on the surface thereof facing away from the shop area with an electrically conductive coating, which is operative to heat the outer pane electrically. The door has solely two mutually parallel glass panes, of which the glass pane facing towards the colder refrigerator or freezer space is provided on the surface thereof which faces towards the colder space solely with an infrared radiation reflective coating or layer.

4 Claims, 1 Drawing Sheet

DOOR CONSTRUCTION FOR VERTICAL REFRIGERATOR AND FREEZER SPACES

This application is a continuation-in-part of application Ser. No. 932,739, filed Aug. 25, 1992, now abandoned which was a continuation of application Ser. No. 542,989, filed Jun. 25, 1990, now abandoned, based on Swedish application No. 8902390-7, filed Jun. 30, 1989.

The present invention relates to a vertical door structure suitable for use in combination with upright refrigerator and freezer spaces, or chambers, of the kind used, inter alia, in every day commodity food stores to display perishable goods.

BACKGROUND OF THE INVENTION

Such vertical door structures include two or more glass sheets which, together with a frame embracing the edges of the glass sheets, form a door leaf. The goods are visible through the door, which can be opened to allow a customer to take either a refrigerated or frozen article from the display, as the case may be. The doors to which this invention pertains are vertically disposed doors, usually hinged on a vertical hinge axis.

When the door is closed, the door surface which faces towards the colder storage space will have a lower temperature than the door surfaces which face towards the warmer shop area.

One problem with doors of this kind is that the outer door surface, i.e., the surface of the outermost pane which faces the warm and humid store air, is cooled to a lower temperature than ambient temperature, such that the surface becomes fogged by condensation of moisture contained in the shop air onto that surface. Naturally, such fogging will obscure the view through the door. Another problem is that when the door is opened, moisture in the store air will condense on the inner surface of the door, i.e., the surface of the innermost pane which normally faces towards the colder refrigerator or freezer space.

The first of these problems has been solved, by using a door in the form of a sealed glazing unit, containing two or three panes of glass, wherein the outer pane, on the rear side of the pane, is provided with an electrically conductive coating, which heats the outer pane electrically. The sealed glazing units used in such door structures normally comprise three glass panes.

The use of a sealed glazing structure of high thermal insulating ability, however, results in a high temperature gradient across the door, which means that, in use, the temperature of the inner door surface will be very low. This results in fogging of said surface when the door is opened, e.g., by a customer, and in some cases results in moisture freezing solid on said surface. Subsequent to reclosing the door, this moisture or frost will disappear in time, due to the low dew point prevailing in the refrigerator or freezer space, as the case may be. Because such refrigerator or freezer spaces in vertical cabinets are equipped with forced circulation of internal cooling air, the mist and frost will disappear relatively quickly, as compared to the case of horizontal freezers or refrigerators where normally there is no forced air circulation and instead free convection is utilized. An example of the later type of horizontal chest freezer is found in my U.S. Pat. No. 4,896,785, dated Jan. 30, 1990.

It is known that the time normally taken for such mist or frost to disappear completely from the inner surface of a vertically disposed glass door pane unit is of relatively long duration. The problem resides in the inability of the mist to disappear quickly enough, before the door is again opened by the next customer which results in further fogging of the door surfaces, and so on. These circumstances can, in some cases, result in the build-up of frost or ice on the inner surface of the door. In many instances, the transparency of the door is greatly impaired or lost completely as a result of such fogging and frosting of the door surface, which seriously detracts from the effectiveness of the display.

Since the decisive factor as to whether or not the door is kept free from mist formation on its glass surface is the time lapsed between successive opening of the door, it is important to endeavor to reduce the time taken to dispel the mist formed on the glass surfaces as a result of opening the door.

SUMMARY OF THE INVENTION

The present invention provides a vertical door structure, on an upright freezer or refrigerator display cabinet, with which the time taken to clear the inner surface of the door, i.e., the time taken for mist or frost to disappear, is greatly reduced. Thus, the invention will enable the goods on display to be seen clearly.

Accordingly, the present invention relates to a vertical door structure for use in combination with upright refrigerator cabinets and freezer spaces or chambers having forced circulation of the cooling air and of the kind used in stores to display everyday commodity products, such door structure including two or more glass panes which together with a frame which embraces the edges of the glass panes, either completely or partially, forms a door leaf and in which door structure the glass pane which faces towards the warm atmosphere of a shop area is provided on the surface thereof remote from said shop area with an electrically conductive coating or layer for heating the glass pane electrically. The inventive door structure is characterized in that it comprises only two mutually parallel glass panes, of which the glass pane facing towards the colder refrigerator or freezer space is provided with an infrared radiation reflecting coating which is the sole coating on the surface thereof facing towards the colder space.

BRIEF DESCRIPTION OF THE DRAWING

The invention will now be described in more detail with reference to an exemplifying embodiment thereof illustrated in the accompanying drawing and also with reference to comparison doors constructed in accordance with known techniques, in which drawing.

DESCRIPTION OF THE PREFERRED EMBODIMENTS

Figure 1:
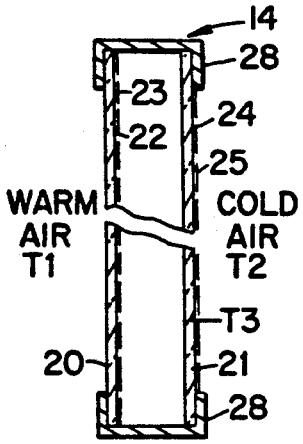
FIG. 1 illustrates in vertical cross-section an embodiment of a vertical door shown schematically and in accord with the present invention.
Figure 4:
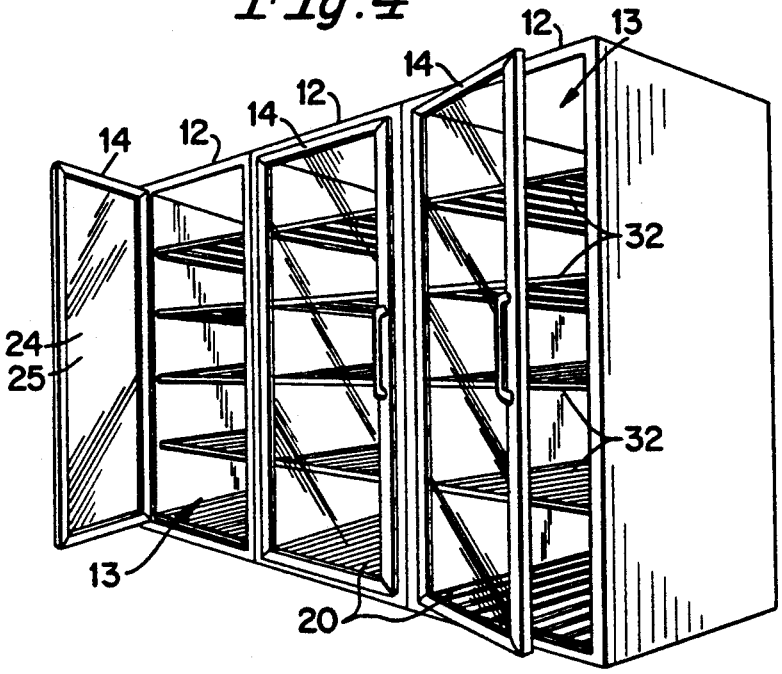
FIG. 4 is a perspective view of an upright group of refrigerated display cabinets with several insulated, vertically hinged doors having glass windows in accord with the invention.
Figure 5:
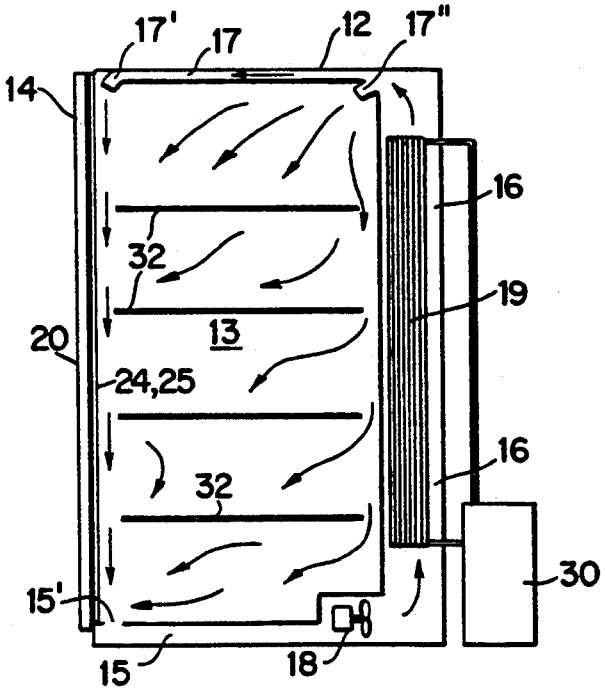
FIG. 5 is a schematic drawing figure illustrating a vertical cross-section of an upright display cabinet to show an example of forced circulation of the cooling air within the enclosed upright cabinet space providing a downward flow of a curtain of cooling air over the inner surface of the cabinet door.

FIG. 1 represents a schematic cross-section of a multi-pane door, in accord with this invention, for use in upright refrigerator or freezer display cabinets similar to those shown in FIGS. 4 and 5. In FIG. 4 each display cabinet includes a door 14, mounted on a vertical hinge axis, which doors for purposes of this description being assumed to be identical and constructed in accord with the present invention as shown in FIG. 1. Shown schematically in FIG. 5, cooling air is circulated through the storage space 13 of such upright cabinets, through lower inlet duct 15, near evaporator duct 16 and top outlet duct 17 by an air circulation fan 18 which forces the air to pass over evaporator cooling coils 19 of refrigeration equipment 30 and thence into and through the cabinet refrigerating space 13, passing out from outlet 17' down over the inner surface of the vertical door and through outlet 17" down past any goods on open shelves 32, e.g., wire and rod units. The cooling air flows into bottom inlet 15' at the lower edge of the door and back through the lower duct 15, through fan 18, as shown by the air flow arrows in FIG. 5. This action results in heat transfer from the inner pane by forced convection causing reduction of the dew point in air adjacent to the fogged inner surface of the door and thereby rapidly dissipates the fog and/or frost on the inner surface of the door.

FIG. 1 is a schematic sectional view of a glass door 14 constructed in accordance with the invention. The words "warm air" found on the drawing refer to the air present in the shopping locality or the like area. The words "cold air" relate to the air present in the refrigerator or freezer space 13 (FIGS. 4 and 5). The reference signs "T1" and "T2" refer to the temperature of the warm air and the temperature of the cold air respectively.

Figure 2:
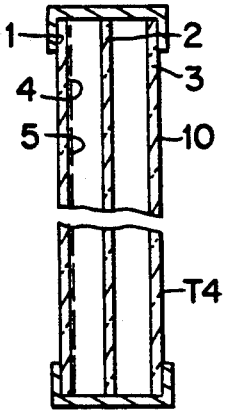
Fig.2 PRIOR ART
FIG. 2 illustrates in vertical cross-section a schematic showing of a first embodiment according to known techniques.

FIG. 2 illustrates schematically a door structure of a conventional design, in which the door comprises three mutually parallel, spaced apart, glass panes, 1, 2, 3., of which the surface 4 of the outer pane facing away from the warm space is provided with an electrically conductive coating 5 which is operative to heat the pane 1. The electrically conductive coating, or layer, is shown in broken lines.

A door of this FIG. 2 construction will constitute an effective insulation between the shop locality and the refrigerator or freezer chamber. One drawback with a door of this construction, however, is that the effective insulation afforded by the door will cause the temperature of the inner surface 10 of the inner pane 3 to be so low as to result in very rapid fogging and frosting of the inner surface of an opened door, as mentioned in the introduction. Practical trials have shown that when the warm air has a temperature T1 of +25° C. and the cold air has a temperature T2 of −23° C., the inner surface of the inner glass pane will have a temperature of −19° C. Obviously when this door is opened and said surface is exposed to the warm, humid shop air, mist will rapidly form on the inner pane 3. Because the temperature of the glass pane 3 is as low as −19° C., it will take considerable time, approximately 75 seconds, for the mist to disappear after closing the door.

In the mentioned trials, the doors were held open for about 6–8 seconds, which corresponds to the normal time a door is help open when a customer removes goods from the refrigerator or freezer space.

Figure 3:
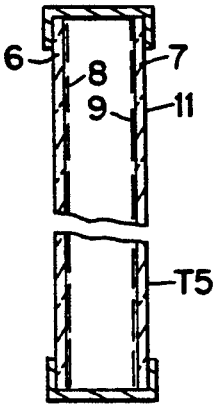
Fig.3 PRIOR ART
FIG. 3 illustrates in vertical cross-section a schematic showing of a second embodiment according to known techniques.

FIG. 3 illustrates another known vertical door construction, in which the door comprises two spaced-apart glass panes 6, 7. In this known door construction, the surface of the outer glass pane 6 facing away from the warm shop space is provided with an electrically conductive coating or layer 8 of said kind. Furthermore, the surface of the inner glass pane 7 facing away from the colder space is provided with a coating 9 which reflects infrared radiation. An example of this construction is shown in U.S. Pat. No. 4,035,608 to M. E. STROMQUIST.

In the case of the FIG. 3 door construction, the infrared reflective coating 9 prevents radiation incident on the door from the shop locality from passing through the door into the refrigerator or freezer space. Instead such radiation is reflected back by the reflective coating to the shop locality. Consequently, a large part of the infrared light is absorbed by the outer glass pane 6 when the light passes in both directions through that outer-pane, as distinct from the case, as in FIG. 2, when no infrared reflective coating is provided. In turn, this means that in FIG. 3 the outer glass pane 6 will be warmer than in the case of outer pane 1 of FIG. 2, where no infrared reflective coating is provided.

Because of the inferior insulation afforded by a double glazing unit as compared with a triple glazing unit, i.e., insulation against the penetration of heat from the store locality, the temperature of the inside 11 of the inner pane 7 of FIG. 3 will be slightly higher, namely −18° C., compared with a door constructed in accordance with FIG. 2, with all other conditions being equal.

It will be understood that the fact of whether the inner surface of the glass pane has a temperature of −18° C. or −19° C. has no significant importance. In the case of a door constructed in accordance with FIG. 3, it will take about 70 seconds before the door is again free from fogging, after opening and closing the door. The corresponding time period for a door constructed in accordance with FIG. 2 is about 75 seconds, as before-mentioned.

The door 14 constructed in accordance with the present invention (FIG. 1) comprises only two mutually parallel glass panes 20, 21 embraced on the door perimeter by channel shaped frame members 28. The innermost surface 22 of the glass pane 20 on the side of the door facing towards the warm atmosphere of the shop locality is provided with an electrically conductive coating or layer 23, operative to heat that pane 20 electrically. The glass pane 21 on the side of the door facing towards the colder refrigerator or freezer space is provided solely on the surface 24 of that pane 21 facing the colder space, with an infrared radiation reflective coating or layer 25 which constitutes the actual surface facing the colder space. Such an infrared reflective coating has a relatively low emissivity factor, which may be as low as 0.2 for instance.

According to one preferred embodiment of the invention, the infrared reflective coating has an emissivity factor beneath 0.2, preferably 0.12 or lower.

The effect of the invention is that at the aforesaid temperatures T1 and T2, the surface 24 of the inner glass pane 21 and of the infrared reflective coating 25 will have a temperature T3 of −15° C., which means that mist forming on the door will have disappeared within a time lapse of about 35 seconds from the moment of closing the door, which is approximately half the time taken with doors of known construction.

This effect is based on the understanding that the low emissivity factor of the infrared coating 25 will cause the radiation exchange between the inner surface 24 of the inner pane 21 to the interior of the refrigerator or freezer space and the goods present therein to be much lower than in the case of the door construction according to FIG. 3, since in this latter case the inner surface 11 of the inner glass pane 7 has an emissivity factor of about 0.9 and radiates heat from the surface 11 at a higher rate. In the case of the aforementioned experiments, the infrared reflective coating had an emissivity factor of 0.12. Heating of the inner glass pane is also assisted to a minor extent by the infrared radiation from the locality incident on the inner glass pane.

It will therefore be obvious that when the infrared reflective coating is applied to the inner surface of the inner glass pane, in a vertical door of an upright cabinet with forced circulation of a curtain of cooling air down over the inside door surface, i.e., in accordance with the invention, instead of on the outer surface of the inner glass pane of a vertical door on an upright cabinet, in accordance with FIG. 3, the time taken for the glass to clear will be shortened from about 70 seconds to about 35 seconds, when all other conditions are equal.

In applicant's prior U.S. Pat. No. 4,896,785, the invention is directed to a horizontal glass cover or a lid for a chest freezer, the glass cover being a one or two pane unit with an infrared reflecting layer on the cold side of the pane adjacent the inside of the chest. The invention therein does not pertain to nor was it proposed or contemplated being used on a vertical door, on a cabinet using heat transfer from the inside of a door by forced convection, rather it involves a lid in which the infrared layer on the inside surface of a glass pane functions in a different way to accomplish a result which works in a different manner to avoid fogging of the undersurface of the lid. It is used with a horizontal chest freezer that does not use forced circulation of air and does not have forced convection and so the purpose of that invention would be defeated if the chest freezer had forced convection.

The invention has been described in the aforegoing with reference to one embodiment thereof. It will be understood, however, that the infrared reflective coating may have an emissivity factor still lower than 0.12, to advantage. A lower emissivity factor will result in maintaining an even warmer inside surface and coating on the inner glass pane which will decrease the time necessary to eliminate the fogging which occurs when the door is open. Forced convection rapidly carries that warmth away when the door is closed.

The present invention shall not be considered to be restricted to the afore-described embodiments, and modifications which come within the scope of the following claims are therefore intended to be embraced therein.

What is claimed and desired to be secured by Letters Patent is:

1. A vertical door structure and upright cabinet structure with refrigerator and freezer cold spaces of the kind normally used in everyday commodity stores to display goods on sale, said upright cabinet structure having a cooling system with forced cooling air circulation within and through the cold space, and having a vertical doorway, and means pivotally mounting said door structure on said cabinet structure on a vertical axis so the door structure is adapted to close said doorway; said door structure comprising two glass panes which, together with a frame which embraces the edges of the glass panes, at least partially form a vertical door leaf, wherein the glass panes of said door comprise solely two parallel, spaced apart glass panes, a first of said parallel glass panes having two surfaces and facing towards the warm atmosphere of a shop area when the door is installed on said cabinet structure, a heat generating electrically conductive coating provided on the surface of said first pane which will be remote from the shop area and being effective to heat said first glass pane electrically; and the second of said two parallel glass panes, having two surfaces and facing towards the colder refrigerator or freezer space when the door is installed on said cabinet structure and is closed, an infrared radiation reflective material coating provided on the surface of said second pane facing towards said colder space, said infrared radiation reflective material coating constituting the sole surface material on the surface of said second glass pane facing the colder space and which said sole surface material provides a radiation exchange with an emissivity factor, to the colder space, which is less than 0.2.

2. A door structure as defined in claim 1, wherein said infrared reflective material coating has an emissivity factor less than 0.12.

3. A door and cabinet structure as defined in claim 1, wherein said cooling system includes air flow duct means within the cabinet with at least one upper duct at the top of said cabinet with at least an airflow outlet adjacent the top of the interior side of the cabinet door; and said duct means include at least a return air flow duct with a return airflow inlet at least adjacent the bottom of the interior side of the cabinet door, whereby a curtain of cooling air flow will pass from said outlet down over said door structure surface and in contact with said infrared radiation reflective coating surface material on said second glass pane.

4. A door and cabinet structure as defined in claim 3, wherein said cooling system includes refrigerator unit with evaporator coils and a circulation fan which receives air from said return air flow duct and forces the air to pass over the cooling system evaporator coils and thence through said one duct and out through said airflow outlet at the top of said cabinet.

* * * * *